United States Patent [19]

Agos

[11] Patent Number: 4,616,688

[45] Date of Patent: Oct. 14, 1986

[54] SIMPLE OR ROTATING TRAVERSERS FOR VERTICAL WINDOW BLINDS

[75] Inventor: Angel Agos, Vitoria, Spain

[73] Assignee: Aryho, S.A., Malago, Spain

[21] Appl. No.: 562,141

[22] Filed: Dec. 16, 1983

[30] Foreign Application Priority Data

Dec. 21, 1982 [EP] European Pat. Off. ..... 8211192.9

[51] Int. Cl.[4] ..... E06B 9/36

[52] U.S. Cl. ..... 160/176 R; 160/178 R; 160/166 A

[58] Field of Search ..... 160/178 R, 166 A, 166 R, 160/168, 172, 176 R, 177

[56] References Cited

U.S. PATENT DOCUMENTS

| | | | |
|---|---|---|---|
| 3,860,056 | 1/1975 | Bruneau | 160/176 |
| 3,996,988 | 12/1976 | de Wit | 160/168 R |
| 4,103,727 | 8/1978 | Spohr | 160/168 R |
| 4,306,608 | 12/1981 | Frentzel et al. | 160/176 R |
| 4,335,775 | 6/1982 | Frentzel et al. | 160/168 R X |

FOREIGN PATENT DOCUMENTS

| | | | |
|---|---|---|---|
| 2510888 | 10/1975 | Fed. Rep. of Germany . | |
| 7301533 | 1/1973 | France . | |
| 2418326 | 9/1979 | France . | |
| 2453266 | 10/1980 | France . | |
| 2031493 | 4/1980 | United Kingdom | 160/178 R |

*Primary Examiner*—Ramon S. Britts
*Assistant Examiner*—David M. Purol
*Attorney, Agent, or Firm*—Sheridan Neimark; A. Fred Starobin

[57] ABSTRACT

A device to control and protect the operating mechanisms of vertical slats for window blinds, contained in a box (1) in which there is a pinion consisting of outer (4) and inner (3) members. The outer member (4) has a partial set of vertical gear teeth and is limited in its rotation at the bottom end of the box. The inner member (3) supports the slat and goes through the outer member, extending above into an orifice (14) in the cover (9) of box (1). It is provided with a projection (3') that limits its rotation inside cover (9) by interacting with projection (23). The two members of the pinion are connected at the top by a tab that corresponds to a notch. The cover 9 can have play with reference to a flexible intermediate wall (24) inside the box.

4 Claims, 10 Drawing Figures

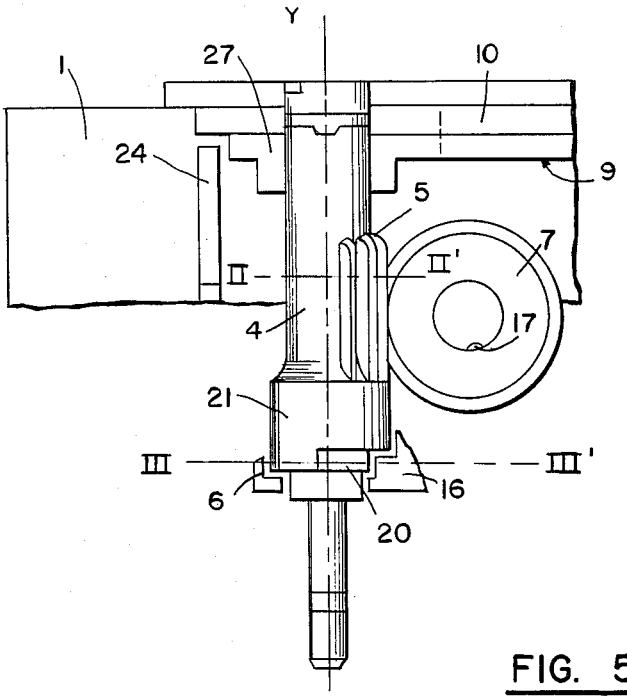
FIG. 5
FIG. 6
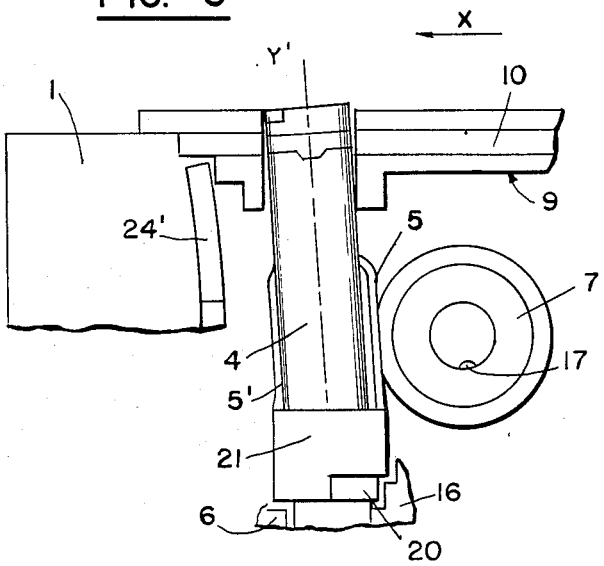

SIMPLE OR ROTATING TRAVERSERS FOR VERTICAL WINDOW BLINDS

This invention relates to the operation of simple or rotating window blind traversers for vertical slat blinds, and more especially, to each of the small boxes from which these vertical slats hang. There is one of these boxes for every slat, and each box has running through it a single shaft that actuates the internal mechanisms, so that depending on which way the shaft is rotated, each of the slats moves in one direction or another. A very common problem with these boxes is protecting their mechanisms to ensure a long operating life of all their components. The safeguard consists in not forcing the internal mechanisms at the end positions of the slats, and in the intermediate positions when some foreign object obstructs the rotation of the slats.

The slats of the blinds are capable of rotating 90 degrees to the right or to the left. When they have rotated that number of degrees in either direction, the internal mechanisms should not be subjected to a force great enough to damage them. This is one of the objectives to be attained.

On the other hand, while the slats are turning, one or more of them may be obstructed by some foreign object that hinders their proper rotation, and in such cases the mechanisms in the boxes must be protected from forces greater than they can withstand. This is another of the objectives to be attained. Also, it should be noted that the slats are often subjected to external force when the shaft is at rest, as for example, when the slats are jolted or subjected to air currents, etc.

In conventional systems there is a series of boxes, from each of which a slat hangs. There is a shaft that runs through each one of the boxes and acts on a horizontal worm inside each box that is suitably keyed to the shaft. Turning this shaft causes the worm to rotate and its external threads actuate a vertical pinion from which the slat hangs.

A number of solutions to these mechanisms are known. For example, patent application FR. 7301533 FRANCIAFLEX exhibited a vertical pinion composed of a hollow cylinder with a circular flange at its base, perpendicular to the axis of the shaft and the cylinder. This flange was beveled and had two diametrically opposed projections and two housings that were also diametrically opposed. The latter were located between the projections at 90 degrees from them. At the bottom of the cup or seating base of the box, there was a pivoting part with projections and housings that corresponded to those of the other part. The pivoting part also had on its bottom side stops that interacted with a radial retention pin located in the bottom of the cup.

The slat was suspended from a hook on the end of a noncircular rod that went through an axial opening in the center of the pivoting part and the central orifice of the hollow cylinder, penetrating a cap at the top end of the cylinder. On the circular inside of the cylinder, resting on the flange, was a spring held under tension by the cylinder cap.

When the worm screw turned, it transmitted the movement to the hollow cylinder. Under pressure from the internal spring of said hollow cylinder, the projections of the cylinder remained in the housings of the pivoting part, forcing the latter to pivot, which carried the slat hook with it. The rotation of the pivoting part was impeded by the cooperation of one of its stops and the radial retention pin at the bottom of the cup. Rotation could continue only because of the spring's elasticity, which allowed the projections of the hollow cylinder to reach the projections of the pivoting part in an unstable position. If the pinion continued to rotate, the vertical force of the spring was transformed into a horizontal component that turned the pivoting part in the opposite direction.

This solution of patent application FR. 7301533 FRANCIAFLEX, used a complex mechanism, with the feature that it could withstand excessive force exerted on it when the slats were in the end positions, but no provision was made for for the possibility of obstacles interfering with the slats while they were rotating.

Patent DE. 2510888-REKO displayed a pinion with a partial set of beveled teeth, inclined from the vertical, and a worm, each of whose threads exhibited escape channels in the ends that allowed the last gear tooth at either end of the pinion to escape if forced beyond its limits in either direction. A cam was connected to the worm near the escape channel of the threads. The cam had a stop surface that engaged the last tooth of the pinion when the direction of the worm was reversed.

Obviously, this mechanism of patent DE. 2510888. REKO protected the mechanisms only at the end positions of the travel of the slats.

Patent FR. 2418326. HUNTER DOUGLAS is also known, which provided a worm with two clearly distinct sections. One of these could not rotate with respect to the shaft, but could slide along the axis of the shaft. The other section could rotate with respect to the shaft. Both sections had sets of teeth in their facing surfaces that allowed them to engage and disengage with one another. Only the second was provided with a spiral rib. This rib engaged the teeth of a ring gear that formed a body coaxially with a segment placed vertically in the traverser. On the lower end of this segment was a hook from which a slat hung.

The two sections of the worm, or engaging element were located between parallel walls of the box. When excessive force was applied, the sides of the box, that were elastically deformable, would be deformed a distance at least equal to the axial displacement range of the two said components of the worm.

If, in fact, the mechanism in patent FR. 2418326-HUNTER DOUGLAS protected its mechanisms at both ends of the rotating range of the slats and during their travel, it offered no protection when the shaft was not in motion.

Patent FR. 2453266-HUNTER DOUGLAS is also known, which consisted of a pinion made with two distinctly different elements. One of these was external, with a set of pinionlike gear teeth, while the other, located in the hollow interior of the former, held the slat at its bottom end. This internal element also protruded at the top end with two arms, that were separated by the hollow. These arms were diametrically opposed, and joined on top by a rounded bridge. For its part, the pinion had diametrically opposed recesses on its upper surface.

When the slat was hanging from said support piece under normal conditions, the upper arms of this piece fit into the recesses on the upper end of the pinion.

When it is desired to rotate the slat, the slat support and the slat are lifted slightly upward because of the nature of the connection between the arms and the recesses they fit into. If the force applied is excessive, stops in the slot support pass elastically over other stops of the pinion.

To a certain degree this mechanisms is similar to that in patent FR. 7301533 FRANCIAFLEX, the difference being that while the latter was designed only to protect the components at the end positions of the slats, patent FR. 2453266 HUNTER DOUGLAS protects both against foreign object interference during travel and at the end positions, but does not protect the box mechanisms when the shaft is not in motion.

The present invention offers a mechanism with the following objectives:

Protection of the mechanisms if the worm continues to operate after the slats have reached their end position in either direction.

Protection of the mechanisms if a slat is obstructed during intermediate travel of the former and by accidental outside forces acting on a slat.

Parallel self-realignment of the slats. This is due to the fact that although the pinions may be variously aligned when they are assembled, when rotation takes place, all the slats will eventually arrive at their end position during rotation and will then be parallel.

The mechanism that forms the object of this invention is housed in an appropriate box through which a conventional actuating shaft passes. Inside the box there is a worm in a basically horizontal position that is keyed to said shaft, so that when the shaft rotates, the worm moves in the same direction as the shaft. The box itself exhibits appropriate housings for the worm in parallel walls, and an intermediate wall that connects these two opposite walls inside the box. The upper portion of this intermediate wall is not connected to the parallel walls, which gives this portion of said wall a certain amount of flexibility.

The top part of the box is a cover that fits into said opposing walls, the wall beside the worm and the said intermediate wall.

The vertical pinion is located between the worm and the inner partition. This pinion is made up of two distinct parts, one of which is hollow inside along its axis and has a set of gear teeth on its external surface. The bottom end is finished with a smooth section of greater diameter with a semicircular keyway cut in its lower portion, and a neck at its upper end that fits into a corresponding neck in the orifice of the cover. This outer member is seated in an orifice in the bottom of the box, in the wall of which there is a projection that acts as a stop, so that when assembled it fits into said keyway, limiting the rotation of the pinion piece to 180 degrees, due to the interaction of the keyway and the projection. Also, the upper neck of this piece has a notch cut in it.

The inner member exhibits a central portion that is completely smooth and fits inside the outer member. The lower end of the inner member is hook-shaped and, when assemled, protrudes through the lower neck of the outer member so that a slat may be hung from it. The upper end of the inner member has a rim that rests on the neck of the outer member. This rim has a tab pointing downward that fits into the notch in the neck of the outer member. On top of the said rim of the inner member is a projection that occupies a part of the total circumference.

The cover exhibits a circular orifice for the passage of rim of the inner member as well as its projection. Inside the orifice is a projection that limits the rotation of the inner member to only 180 degrees.

The inner member is housed in the outer member so that the tab of the inner member fits into the notch at the top of the outer member. The slat hangs from the hooked portion so that the interconnection of both members is assured in rest position. The projection on the upper surface of the inner member, for its part, rests in the orifice in the cover and is limited to 180 degrees of rotation by the projection in the said orifice, as we have stated.

In any given position, the shaft or main actuating rod is actuated so that the worm rotates and transfers motion to the whole pinion component, both the inner and outer members, and the slat rotates. As the shaft continues to rotate, there comes a moment at which the last tooth of the geared portion of the pinion is reached, and theoretically, this point could be exceeded. Obviously, we would find that motion would then cease and rotation of the pinion would be interrupted, because gear meshing is lost, making rotation in the opposite direction impossible.

However, when the worm and the pinion are engaging at the last tooth on the outer member of the pinion, tension is obviously exerted on the shaft of the pinion body by the worm's raised portion contacting the last tooth which is transmitted to its upper and lower ends where it is supported. Since the upper end is connected to the cover, and this cover is in contact with the intermediate wall that is somewhat flexible, said wall is forced to bend. This consequently produces a displacement of the cover in a horizontal plane which is sufficient to make the axis of the shaft lose its verticality and also break contact with the worm. When the worm ceases to operate and the pressure is eliminated, the shaft of the pinion returns to its vertical position and can be turned in the opposite direction.

These maximum rotations of the worm to the right or to the left are in turn controlled by the lower projection in the box in relation to the keyway in the outer member of the worm, so that contact is made between the lower projection in the orifice of the box with the extreme lateral walls of the keyway in said outer member. This contact, moreover, represents sufficient basis for the pinion shaft to deviate from its vertical position.

It is therefore established that as the slats approach their rotational limits, continued operation of the shaft, acting on the worm and the worm on the pinion produces a displacement of the body of the pinion that acts as a clutch to rotation. This occurs at the last tooth of the geared portion so that said last tooth maintains contact with the worm, with the effect that rotation in the opposite direction is possible and the mechanism is obviously protected from damage.

As was noted earlier, objects can interfere in the middle of the travel of the blinds, which can impede their free movement, causing them to be held back and possibly damaging the mechanisms, all of which can happen when the main shaft is operating. These actions can also occur when the blinds are at rest, that is, when the shaft is not in motion, due to jolting or being brushed against, or subjected to strong air currents, etc.

In the first instance, when excessive force of this kind is produced, the downward tab of the inner member of the pinion and the upper notch in the edge of the outer member of the pinion break contact and the inner member of the pinion moves upward. This contact, under normal conditions, is assured because the very weight of the slat on the inner member is sufficient to keep the tab of the inner member in the upper slot of the outer member and allow them to rotate normally together.

When the force exerted by the obstacle exceeds the force exerted by the weight of the slat, the inner member moves upward, and breaking contact with the outer member of the worm, stops rotating, and the outer member continues to rotate without exerting force on the mechanism. When a slat is held back, its angle becomes different from the other slats, and when this becomes evident, the obstacle can be removed, and the worm can be turned in the opposite direction, returning it to its initial position.

When a slat is acted upon accidently while at rest, and the shaft that turns the worm is not operating, the inner member is raised in the same manner and can rotate freely.

The engagement of the downward tab at the top end of the inner member of the pinion with the upper notch in the outer member of the pinion is achieved through their coinciding shapes, which form inclined planes of mutual contact. According to the angle chosen, the force required for their disengagement can be varied.

Also to be observed is the capability for parallel selfrealignment of the slats, because even if the pinions are assembled in different positions, when they are all set in rotation, they will eventually arrive at the end position of that rotation, so that they will be parallel again when turned in the opposite direction.

The upper cover of the box is introduced by pressure in the two opposing walls that support the worm and in the external wall of the box located between them. This introduction is completed by contact with the flexible portion of the intermediate wall, with which the cover is in contact, either diretly or by small projections on the part of the cover next to the intermediate flexible wall. In any case, the press fitting of the cover in the box does not obstruct the necessary play for its horizontal displacement, when this is required, as has been shown.

All of the above is reflected in the accompanying drawings, which describe the following:

FIG. 5 refers to a view of the mechanism in the middle position of operation, with the worm facing head on.

FIG. 6 specifies the position in which the shaft of the pinion body deviates from the vertical.

Figure 7:
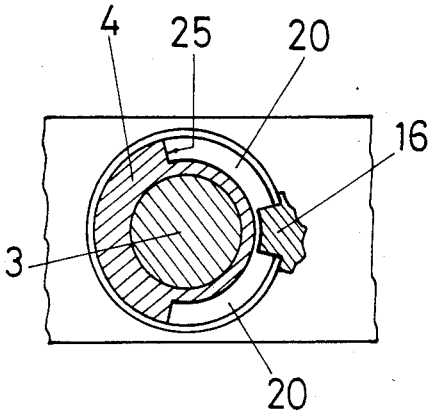

FIG. 7 is a cross-section along line III—III' of FIG. 5.

Figure 8:
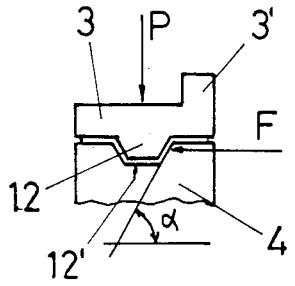

FIG. 8 corresponds to an explanatory view of the pinion's behavior under the weight of the slats.

Figure 9:
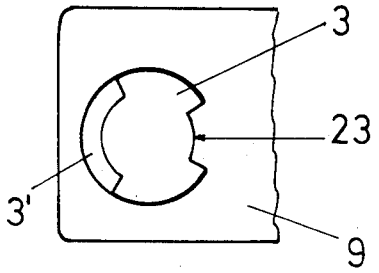

FIG. 9 is a top view of the upper end of the inner member of the worm and the cover of the box.

Figure 10:
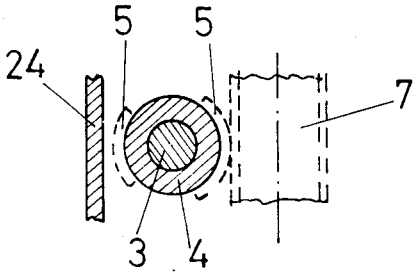

FIG. 10 corresponds to cross-section II—II' through FIG. 5.

Figure 1:
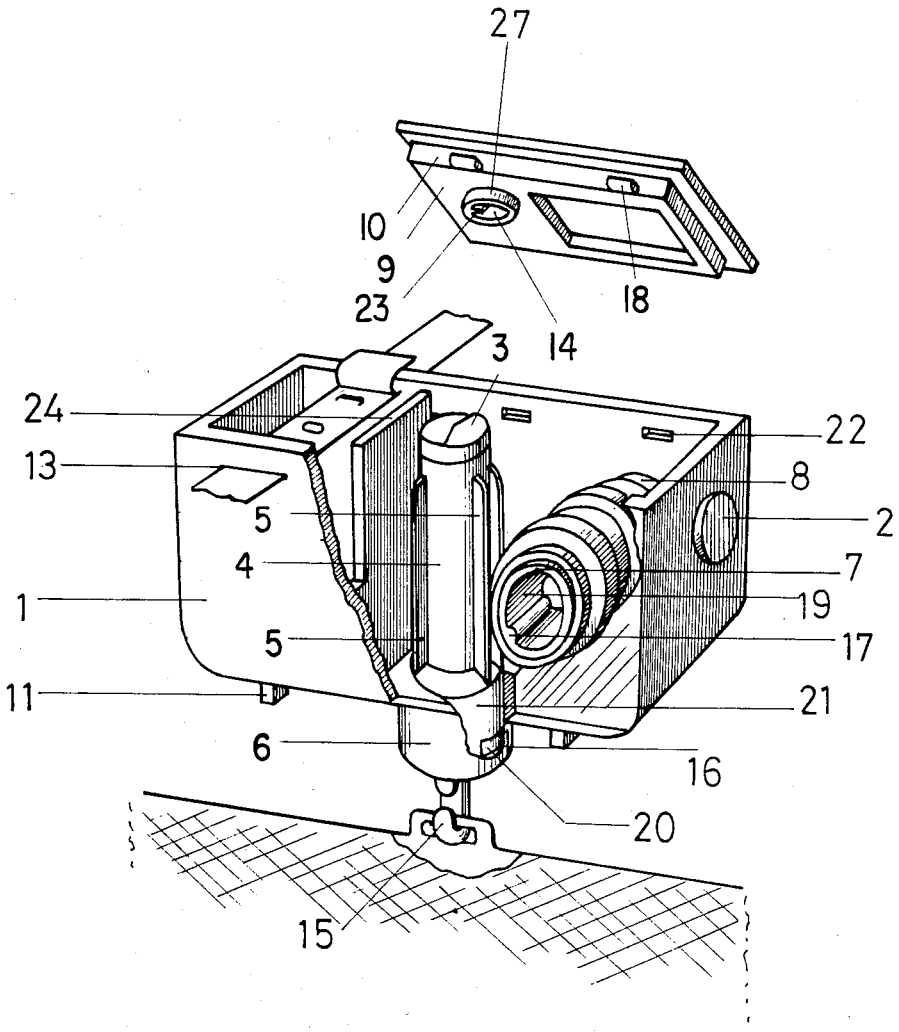
FIG. 1 is a general perspective of the complete set of mechanisms that are the object of this invention, from which the slat hangs.

With regard to these drawings, and more concretely to FIG. 1, a mechanism box (1) is shown, with a conventional worm (7) running through it, and external bosses (2) that guide the box on a conventional installation, not shown. Shown inside the box are the draw tapes (13) and an internal intermediate wall (24) in said box (1), its upper portion not in contact with the main walls of the box (1). The cover (9) of the box is shown, with small projections (18) to be fitted into openings 22 in the walls of the box that hold the worm (7) and the inner side of the wall that has the boss (2). The cover will later rest on the top opening of the box with the edge of depending portion 10 against the flexible intermediate wall (24) and can move horizontally since the length of openings 22 is greater than the width of projections or lugs 18 allowing movement of projections 18 along openings 22 when the pinion body is displaced from the vertical.

The body of the pinion is vertical with respect to the worm (7) and is seated in the bottom (6) of the box (1) and in the orifice (14) in the cover.

Figure 2:
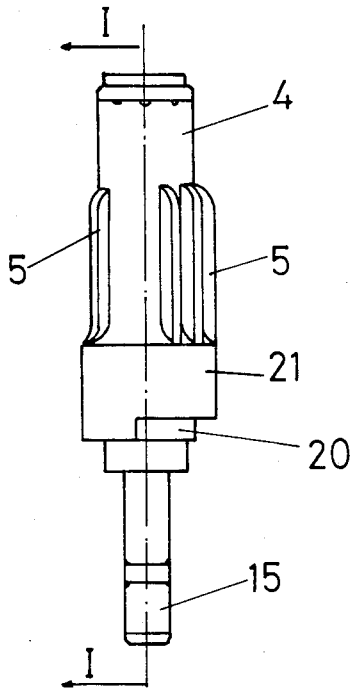
FIG. 2 is an elevation of the pinion.
Figure 3:
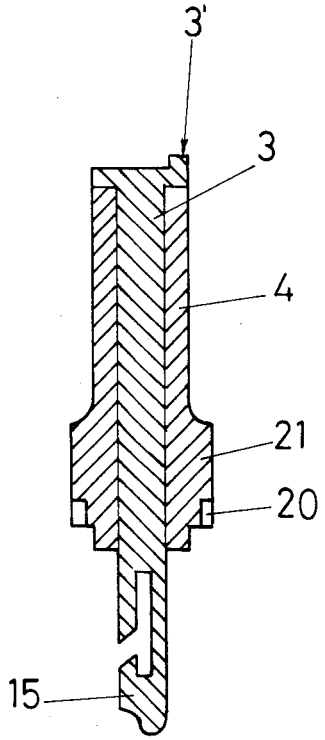
FIG. 3 is a cross section along I—I' of FIG. 2.

According to FIGS. 2 and 3, and in relation to FIG. 1, the body of the pinion is composed of an outer member (4) and an inner one (3). The outer member (4) displays toothed zones (5) separated by smooth zones, a lower portion (21) with a keyway (20) and a neck at the bottom. The inner member (3) lies on the inside of (4) and protrudes at the bottom like a hook (15) for the slat, and also protrudes above.

Figure 4:
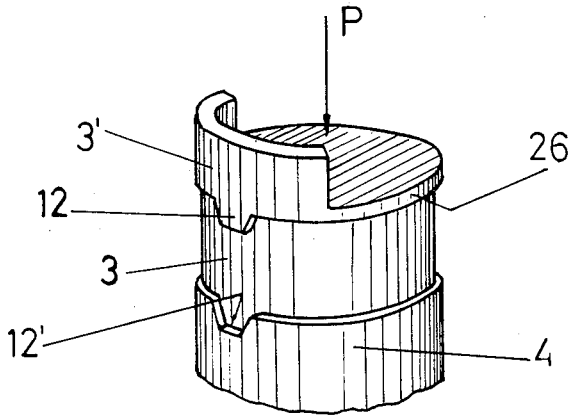
FIG. 4 shows the upper connection between the inner and outer members that make up the pinion.

In FIG. 4, the connection between members (3) and (4) can be seen. Tab (12) rests in notch (12') of (4). Also shown is projection (3') on the exterior face of (3).

FIG. 5 shows a normal operating position, in which the worm (7), driven by the rod or shaft, turns the pinion body, that is to say, the outer member (4) of said pinion body. Pinion body is seated in the bottom of the box, at the bottom of which there is a projection (16) (also in FIG. 1) that limits the rotation of outer member (4). The member is also supported in the neck (27) of the cover (9).

According to FIG. 6, when the worm (7) has made (4) turn as far as the last tooth (5) on its righthand side, a deviation of the mechanism from the vertical can be observed since stops prevent further rotation of the pinion body, forcing a raised portion of worm 7 to press against the last tooth 5 displacing the pinion body to its new axis Y with the top and horizontally displacing cover 9 with its depending edge pressing against the flexible intermediate wall (24). Here in FIG. 6 prime marks are used to show the new positions of the outer body (4'), the teeth (5'), axis Y' and the flexible wall (24'), as well as the displacement of box cover (9), shown by arrow X, to position (9').

FIG. 7 is a cross-section along III—III' of FIG. 5, showing the inner body (3) of the pinion, the outer body (4) of the same, as well as the keyway or recess (20) in body (4), whose travel is limited to 180° degrees by the projection (16) that contacts the sides of the keyway when (4) rotates in either direction.

FIG. 8 shows the upper connection between the inner body (3) and the outer body (4), with the angle of inclination of the walls of (12) and (12'). Simultaneous rotation of (3) and (4) is produced when component P, that corresponds to the weight of the slat that (3) supports, is greater than the perpendicular force F. Conversely, when the lateral force F is greater than component P, displacement occurs between (12) and (12') and the inner body (3) of the pinion rises.

FIG. 9 shows a partial top view of the cover (9), with the partially circular projection (3') and the projection (23) of orifice (14) of cover (9).

Finally, in FIG. 10, which corresponds to a partial cross-section along II—II' of FIG. 5, we can see the flexible intermediate wall (24), the inner body (3) of the pinion, and outer body (4) of the pinion as well as the sets of teeth (5). Those on the right, according to the position of the figure, are engaged with the worm (7) and those on the left approaching the intermediate wall (24)

Further, in accordance with the above, worm 7 is conventional and simple, i.e., it is in one piece. This worm 7 acts on the pinion, which is constituted by two single members, one outer 4 provided with teeth 5, not completely, and the other inner 3 which projects downward to constitute hook 15 and upward portion 26. Portion 26 of inner member 3 exhibits the downward projection 12' that is introduced into recess 12, upward, of outer member 4. Portion 26 of the inner member exhibits a partial upper projection 3', that is partially circular.

Worm 7, when it rotates, acts on teeth 5 of outer member 4 of the pinion, so that the slats of hook 15, which are able, of inner member 3 rotate. This rotation is feasible, due to the fact that the weight of the slat that pulls down from inner member 3 causes recess 12 of outer member 4 and projection 12' of inner member 3 to be inserted. Consequently, the rotation of worm 7 provides the rotation of member 4 and the latter provides the rotation of member 3.

Inner portion 26 of member 4 is inserted into well 6 of box 1 and on the inside of this well is a projection 16 downward from the well. Portion 26 exhibits a partial circular keyway 20 in which projection 16 comes out from the well, so that the rotation of member 4 is limited when projection 16 strikes against ends 25 of keyway 20 (FIGS. 1-3-7) and limits the rotation.

Internal member 3 of the pinion is smooth and is housed in 4 so that it can slide upward and go down in relation to what is indicated in FIG. 3.

The upper ends of 4 and 3 in turn are housed in cover 9. This cover 9 exhibits flanges 18 that are housed loosely in recesses 22 of box 1 which facilitates movement in direction X indicated in FIG. 6, or horizontal movement.

Cover 9 exhibits a downward neck 27 that provides a hole 14 that can be entirely open or closed partially and whose mission is to prevent vertical lifting of the pinion to avoid losing contact in its housing with well 6. For this purpose, neck 27 exhibits an inside projection 23 in it orifice 14, said projection 23 acts as a limiting stop at the upper front face of inner member 3 on which projection 3' is made. This projection 3' serves to avoid incorrect mounting of the unit of pinion 3–4 within member 1 and cover 9, and can occupy a greater or larger sector in the upper circumferential part.

Intermediate wall 24 of box 1 is partially separated from contact with said box (FIG. 1), so that it enjoys flexibility. Portion 10 of cover 9 is located, almost in contact with said wall 24 in the perpendicular portion of FIG. 5.

In regard to teeth 5 of outer member 4 of the pinion (FIG. 10), the right partial gear teeth according to FIG. 10 are three that engage with pinion 7 and those on the left do not touch intermediate wall 24 and therefore their sole technical function is to avoid unnecessary plays in the assembly. The teeth that work are the ones on the right.

In accordance with this structure, the functioning is as follows:

Normal rotation of the slat, and stops of said turning:

Worm 7 is actuated and makes outer member 4 of the pinion rotate to engage said worm 7 with teeth 5 of said member 4 either toward the right or toward the left. Since the slat is supended from hook 15 of inner member 3, and the latter is connected by 12' in 12 of member 4, the weight itself—P—of the slat causes the interconnection of 3 and 4 by 12 and 12' to be effective and the slat rotates to the right or left.

When the ends or stops of rotation of the slat are reached, the last tooth 5 of member 4 is reached, and if it continues rotating, the circumstance could arise of contact being lost between worm 7 and teeth 5, making it impossible to turn the slat back the other way because of said loss of meshing. This end position coincides with the contact of projection 16 of well 6 with stops 25 of recess 20 of outer member 4 so that this contact causes unit 3–4 of the pinion to pivot downward, and its upper end 26, housed in cover 9, forces said cover toward flexible wall 24 (FIG. 6), the Y axis of the pinion losing its verticality but without losing contact with the last tooth 5 in its position, and indeed losing contact with worm 7, which, although it continues to rotate, does not engage with teeth 5.

If it is desired to perform a rotation in the opposite direction, 16 of well 6 stops twisting at stops 25 of unit 4 and the Y axis returns to its verticality whereby worm 7 again engages with teeth 5.

Obstacles during travel of the slats:

When worm 7 is rotating and some obstacle prevents the rotating of any slat, projection 12 of inner member 3 and recess 12' of outer member 4 slide and part 3 is lifted. This lifting is slight FIG. 4, but sufficient not to force the mechanisms, so that the parts do not suffer and the slat stays without rotating when inner member 3 is not actuated. On the other hand, this lifting is also controlled by projection 23 of orifice 14 of the neck of cover 9 (FIG. 9).

This retention in any slat is noted by its position with respect to the rest, making it possible to remove the obstacle so that in turning back the other way, the worm 7 comes back to its initial position.

Blows on the slat without maneuvering the worm:

In this case, actuation by blows on a slat also causes lifting of inner member 3.

Self-positioning of the slats (in parallelism):

If pinions 3–4 are set in different positions in relation to one another, there is no problem since it suffices to make a rotation to the stop, in one direction until all pinions 3–4 make a stop, and then to make a rotation in the opposite direction in which said rotation is made with exact parallelism of said slats.

I claim:

1. A device to control and protect the operating mechanisms of vertical slats for window blinds actuated from a main shaft comprising a box for each of the slats containing the mechanism of the device;

a worm gear horizontally mounted in said box and connected to be rotated by the main shaft;

a pinion mounted vertically in said box adjacent to said worm gear;

said pinion including a hollow external body having a lower portion housed in a vertical position in the bottom of said box, said lower portion having an annular keyway indented therein with end walls at each end of the keyway, a projection from the bottom of said box which enters said keyway and limits the rotation of said external body by contact with said end walls of said keyway to approximately 180 degrees, an internal body housed within said external body having an upper circular boss positioned to rest on the upper edge of said external body and a circular arch-shaped projection extending upward from said upper circular boss, a vertical toothed portion on said external body positioned to contact said worm gear for rotation of said external body, said external body and said internal body having a notch on one of said bodies and a matching tooth to fit in said notch on the other of said bodies;

a lid covering a portion of said box having a portion to receive said circular arch-shaped projection;

a hooking means on the bottom of said pinion for supporting a slat;

an internal vertical wall having at least a flexible upper portion with said upper portion adjacent a side of said lid;

means to move said pinion from its vertical position to a position at a slant from the vertical towards said internal vertical wall;

the movement of said pinion moving said lid against said flexible upper portion of said internal vertical wall with the return of said pinion to a vertical position returning said lid away from said internal vertical wall.

2. The device of claim 1 further characterized by said lid having lugs extending therefrom;

said box having openings in the sides thereof to receive said lugs;

said openings having a greater longitudinal length than said lugs to allow movement of said lugs along said openings and therefore corresponding horizontal movement of said lid.

3. The device of claim 1 further characterized by said lid having a protruding neck depending from said lid with an opening therein to receive at least said circular arch-shaped projection;

said opening in said protruding neck having projection means in said opening to limit the rotation of said circular arch-shaped projection and said internal body.

4. The device of claim 1 further characterized by a lifting of said internal body from said external body and the separation of said tooth from said notch in said bodies when any external actuation of a slat is of such force so as to exceed the downward force of the weight of the slat.

* * * * *